United States Patent [19]

Schall et al.

[11] Patent Number: 4,779,897

[45] Date of Patent: Oct. 25, 1988

[54] APPARATUS FOR PRODUCING BLOCKS WITH AT LEAST ONE POCKET DIVIDER, AS WELL AS POCKET DIVIDER

[75] Inventors: Walter Schall; Gerhard Schnell, both of Neuffen, Fed. Rep. of Germany

[73] Assignee: bielomatik Leuze GmbH & Co., Fed. Rep. of Germany

[21] Appl. No.: 947,635

[22] Filed: Dec. 30, 1986

[30] Foreign Application Priority Data

Jan. 25, 1986 [DE] Fed. Rep. of Germany ..... 3602210

[51] Int. Cl.[4] ..... B42D 5/00; B42B 5/00; B31B 19/00; B31F 7/00

[52] U.S. Cl. ..... 281/38; 156/291; 493/217; 493/447

[58] Field of Search ..... 281/38; 156/196, 226, 156/217, 227, 224, 291, 548, 461; 223/224; 344/345; 379/38; 282/11.5; 493/254, 248, 244, 227, 231, 235, 243, 917, 220, 224, 447, 344

[56] References Cited

U.S. PATENT DOCUMENTS

| | | | |
|---|---|---|---|
| 2,150,275 | 3/1939 | Goder | 493/224 |
| 2,791,866 | 5/1957 | Cross | 493/344 |
| 2,873,566 | 2/1959 | Sylvester et al. | 493/224 |
| 3,647,360 | 10/1972 | Chamberlain et al. | 156/291 |
| 3,773,596 | 11/1973 | Kato | 156/217 |
| 3,776,798 | 12/1973 | Milano | 156/291 |
| 3,802,326 | 4/1974 | Shore | 156/291 |
| 4,557,715 | 12/1985 | Robinson | 493/447 |

FOREIGN PATENT DOCUMENTS

| | | |
|---|---|---|
| 0124811 | 4/1984 | European Pat. Off. . |
| 472872 | 3/1929 | Fed. Rep. of Germany . |
| 1116630 | 11/1961 | Fed. Rep. of Germany . |
| 95854 | 2/1973 | Fed. Rep. of Germany . |
| 3018987 | 10/1983 | Fed. Rep. of Germany . |
| 866153 | 4/1961 | United Kingdom . |

*Primary Examiner*—E. R. Kazenske
*Assistant Examiner*—Paul M. Heyrana, Sr.
*Attorney, Agent, or Firm*—Steele, Gould & Fried

[57] ABSTRACT

An apparatus (24) for the simultaneous production of all the sheet layers, including pocket dividers, for blocks, as well as for the complete production of said blocks has a manufacturing or production means (25) for the pocket dividers folded along a fold line and glued along a line at angles thereto, in which the pocket dividers are simultaneously cohesively produced in multi-unit size form over the working width in the same way as the remaining sheet layers of the block, then the remaining multi-unit size partial layers of the block are supplied and finally are cut commonly into the individual units. This leads to a fully automatic production of blocks comprising pocket dividers without any intermediate storage of the pocket dividers and as each of the pocket dividers can be produced with only one single back layer, a considerable material saving is achieved.

30 Claims, 6 Drawing Sheets

Figure 3:
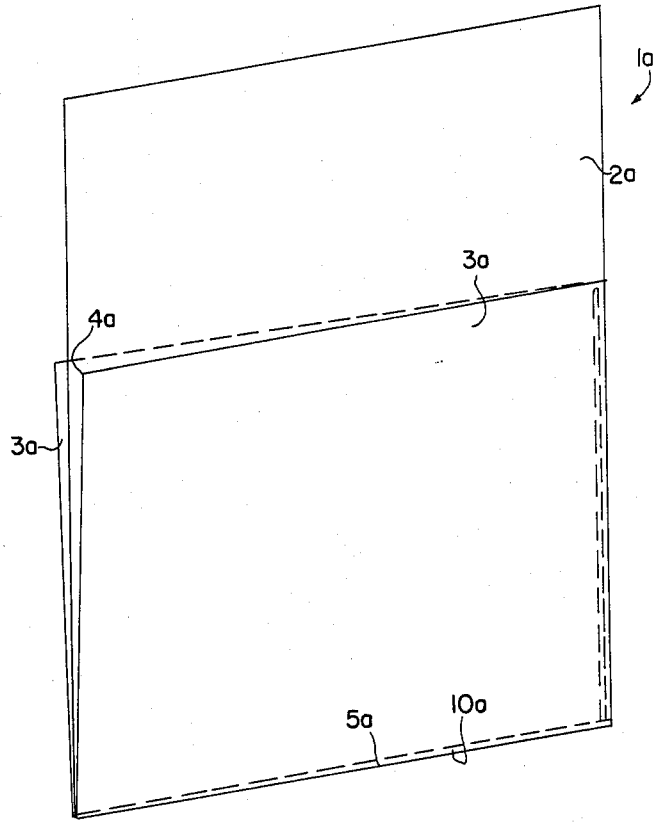

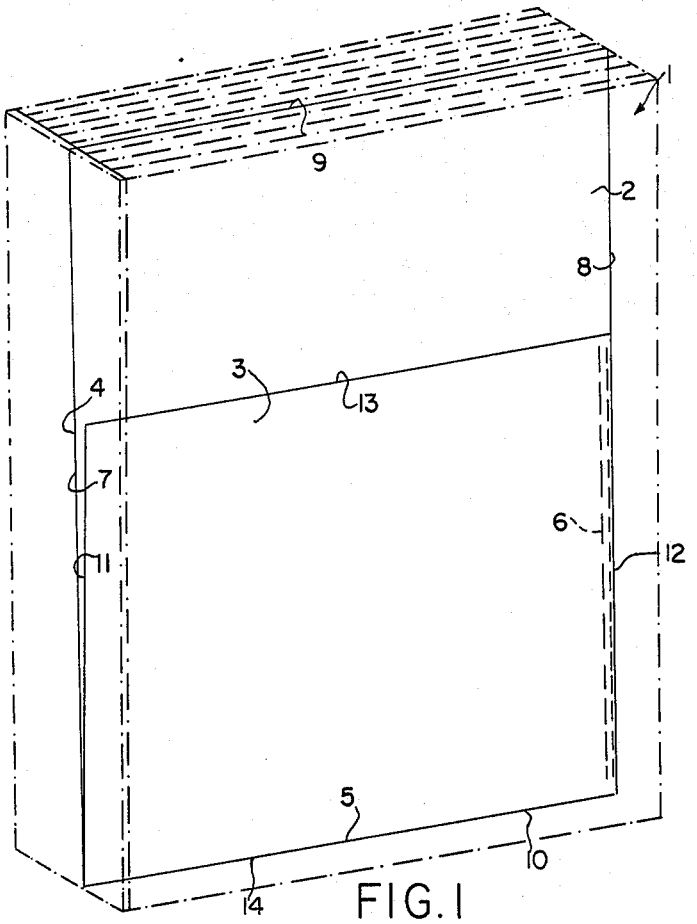
FIG. 1
FIG. 2
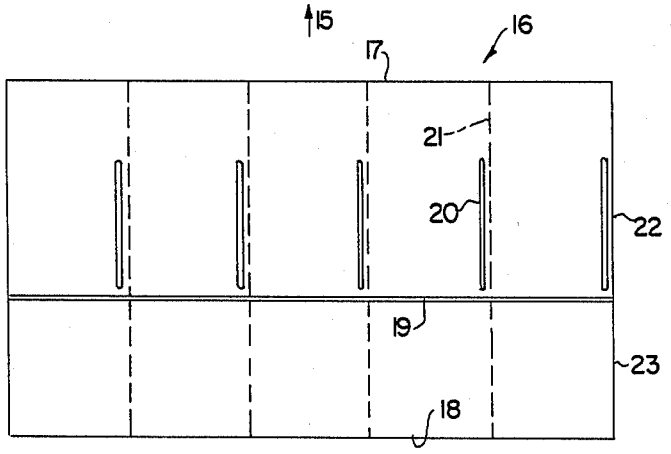

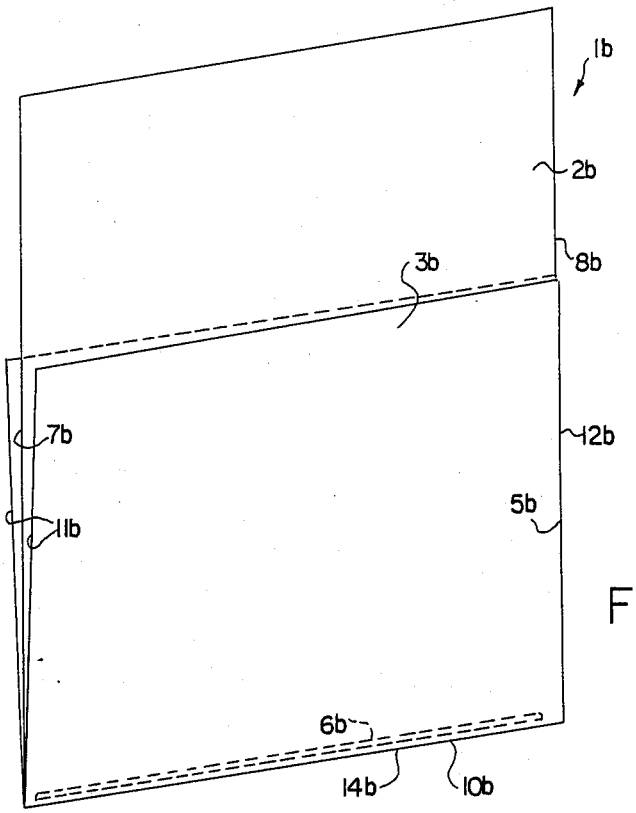
FIG. 5
FIG. 6
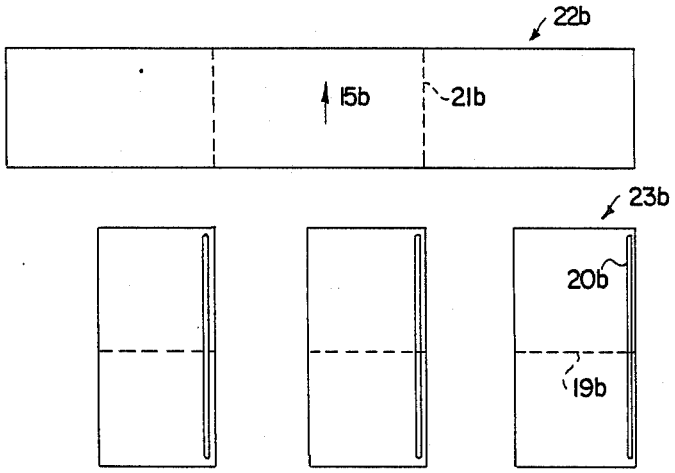

APPARATUS FOR PRODUCING BLOCKS WITH AT LEAST ONE POCKET DIVIDER, AS WELL AS POCKET DIVIDER

The invention relates to an apparatus for producing multilayer blocks of material layers of paper or the like, which are combined by a back binder to form a block with at least one pocket divider forming a pocket by means of additional layer connected thereto on one side of a back layer, whereby along a conveyor path or belt for the material webs the apparatus has a supply means for supplying the material webs determining the working width, a cutting device for the cross cutting of the material webs over several juxtaposed block unit widths at right angles to the feed direction, a cutting device for the longitudinal cutting of the individual unit size and a supply station for supplying the pocket dividers to the paper layers.

Such pocket dividers are generally used as separating or dividing parts, which are inserted in blocks bound at the back, so as to divide up the block into different sections. These dividing parts are provided on the front and/or back with pockets, in which the user can place in notes, inserts or the like. It has not hitherto been possible to produce such blocks fully automatically on a single machine. Instead of this the dividing part have had to be initially made separately from correspondingly large material sheets by double folding along fold lines at right angles to one another, followed by intermediate storage up to the further processing thereof. During the production of the block, the material layers thereof are firstly collected in partial stacks corresponding to the desired arrangement of the dividing parts, the latter are supplied to said partial stacks and then the latter are collected to give the total block to be bound together with the dividing parts. The supply of the dividing parts to the partial stacks must take place after the longitudinal cutting of the individual unit sizes, because as a result of their folded configuration, the dividing parts cannot be prefabricated in multi-unit size form and then cut into the individual unit sizes with the remaining material layers of the block. This leads to an extremely complicated production process, which cannot take place on so-called semiautomatic machines and which is detrimental to mass production. Due to its double folding, each pocket divider has a double back layer, which wastes a considerable amount of material, particularly as the dividing parts generally comprise a somewhat stiffer and therefore heavier and more expensive cardboard material than the remaining material layers of the block.

An object of the present invention is to provide an apparatus of the aforementioned type enabling blocks with pocket dividers to be produced in a particularly simple manner, so that mass production is made possible without any intermediate storage of the prefabricated dividing parts.

According to the invention this problem is solved in that upstream of the cutting device for the longitudinal cutting of the individual unit sizes and at least on the working width, the supply station issues into the conveyor belt and is constructed for the supply of pocket dividers collected together in one-part multi-unit size form at right angles to the conveying direction. Thus, the pocket dividers are collected together in a union extending over the entire working width, in the same way as the remaining material layers of the block and together therewith and only then are they cut commonly with said material layers to provide the individual unit size widths, which on the one hand permits a very inexpensive manufacture and on the other ensures a flush termination of the pocket dividers with the remaining material layers of the block.

It is conceivable to prefabricate the pocket dividers in multi-using unit size form and to supply these in this form to the conveyor belt. However, it is particularly advantageous if the supply station is provided at the end of a further conveyor path or belt of a manufacturing means for the pocket dividers, which preferably has along its conveyor path at least one supply means for a material web, a cutting device for the strip cutting of the material web over several juxtaposed block using unit size widths at right angles to the feed direction and a joining station with a number of joining devices corresponding to the number of unit sizes corresponding to the working width for fixing additional layers to the back layers along in each case one unit size edge parallel to the feed direction. Thus, the pocket dividers can be manufactured simultaneously with the block in a fully automatic manner and on a single machine. The pocket dividers are initially prefabricated in a cohesive multi-unit size form and are then cut with the rest of the block into the individual unit size widths.

Following the cutting device, the manufacturing means appropriately has a folding station for the simple folding over the working width of the additional layers from the back layers, so that each back layer is constructed in one piece with the associated additional layer, but the pocket divider only has a single fold. In this case the back layer only has a pocket on one side.

However, if the pocket divider is to be provided with a pocket on both sides of the back layer, then the manufacturing means has a material web supply means for the back layers and a separate material web supply means for the additional layers and for both material webs there are separate cutting devices for the strip cutting over several juxtaposed block unit size widths at right angles to the feed direction. Preferably a folding station following said cutting devices in the feed direction for the continuous folding of the additional layers over the working width forms a bringing together station for assembling in each case one, particularly multi-unit size, additional layer with a multi-unit size back layer. The multi-unit size back layer is consequently brought together with and connected to the associated additional layer or layers before or during the folding of the latter. If the additional layers are not cohesive in multi-unit size form, then they are supplied in a spaced, juxtaposed, strip-like manner in a position corresponding to the unit size raster or grid, folded along a fold at right angles to the feed direction and then joined to the multi-unit size back layer, so that thereby they are juxtaposed cohesively in multi-unit size form. For obtaining a clean fold, it is appropriate if the additional layers are blocked in slot-like manner along the fold lines provided prior to folding, which appropriately takes place together with the strip cutting at right angles to the feed direction.

Very simple joining of the additional layers to the back layers is obtained if the joining station has an adhesive or glue application station, which is preferably upstream of the folding station in the feed direction. Thus, in the folding station the layers which are to be joined together, whereof at least one is provided with a linear adhesive strip parallel to the feed direction, are placed on and pressed against one another for forming the adhesive glue.

The inventive construction makes it possible to provide the feed direction for the conveyor path either parallel to the back edge for the binding or at right angles to said back edge. In the latter case, the pocket dividers are preferably produced in such a way that the juxtaposed additional layers do not directly adhere to one another prior to unit size cutting and are instead juxtaposed in spaced manner and are only joined by means of the multi-unit size back layer.

A very space saving construction of the apparatus is obtained if the feed direction of the manufacturing means for the pocket dividers is essentially opposite to the feed direction of the remainder of the apparatus and if the outlet end of the manufacturing means is connected by means of a conveyor to the supply station, the conveyor preferably being positioned above the remaining apparatus.

The invention also relates to a pocket divider for back-bound blocks of material layers of paper or the like, with a back layer and an additional layer fixed thereto for forming a pocket and which is connected to the back layer at right angles to the back edge and/or to an edge facing the same and is secured with respect to the back layer in the vicinity of said edges. This pocket divider is to be constructed in such a way that in the case of simple construction it has very accurate boundary edges and a high dimensional stability. This is achieved in that at least one of the secured outer edges of the additional layer and the associated edge of the back layer are defined by congruent cutting edges and are secured by directly fixing their facing inner surfaces to one another. It is also conceivable that the outer edge of the additional layer facing away from the back edge and/or an outer edge of the additional layer at right angles to the back edge and the particular associated edge of the back layer are defined by congruent cutting edges and by the direct fixing of their facing inner surfaces are secured with respect to one another, so that a completely fold-free production of the pocket divider is possible. However, it is particularly advantageous if only a single outer edge of the additional layer and the back layer are bounded by a common cutting edge and if a single outer edge of the additional layer preferably connected at right angles to said cutting edge emanates from a fold. This fold can be connected in one piece to the back layer or can be provided on a separate material blank forming the additional layer and which receives the associated outer edge of the back layer, preferably in the manner of a plugging connection and in each case forms one pocket with both fold legs on either side of the back layer.

The inventive apparatus and pocket divider make it possible to construct the back layer in single layer form, which leads to a considerable material saving. Binding to a block can e.g. take place by adhesive, wire comb or spiral binding and in the two latter cases the holes for the binding can be punched adjacent to the back edge in partial layers of corresponding thickness.

This and further features of preferred further developments of the invention can be gathered from the description and drawings, it being possible to realize the individual features either singly or in the form of subcombination in an embodiment of the invention and in other fields. The invention is described in greater detail hereinafter relative to non-limitative embodiments and the attached drawings, wherein show:

FIG. 1 An inventive pocket divider in perspective representation.

FIG. 2 A multi-unit size material web portion prior to folding for producing pocket dividers according to FIG. 1.

FIG. 3 A further embodiment of a pocket divider in a representation corresponding to FIG. 1.

Figure 4:
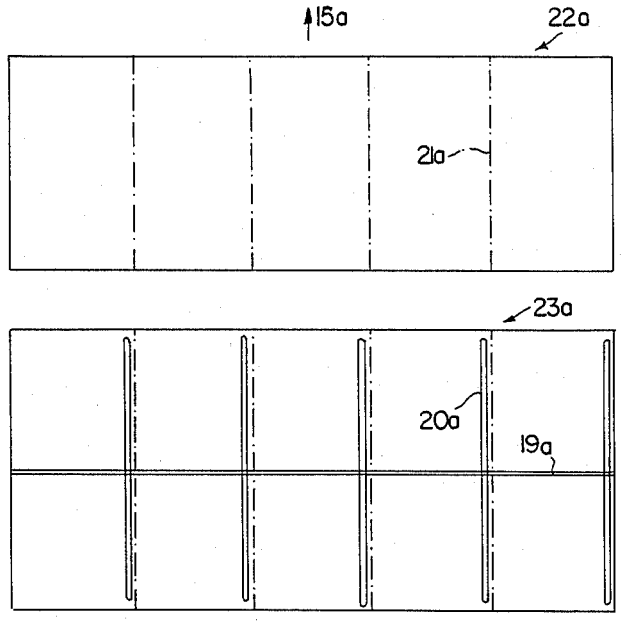

FIG. 4 The two material web portions for producing the pocket divider according to FIG. 3 in a representation corresponding to FIG. 2.

FIG. 5 A further embodiment of a pocket divider in and

FIG. 6 representations corresponding to FIGS. 3 and 4.

Figure 7:
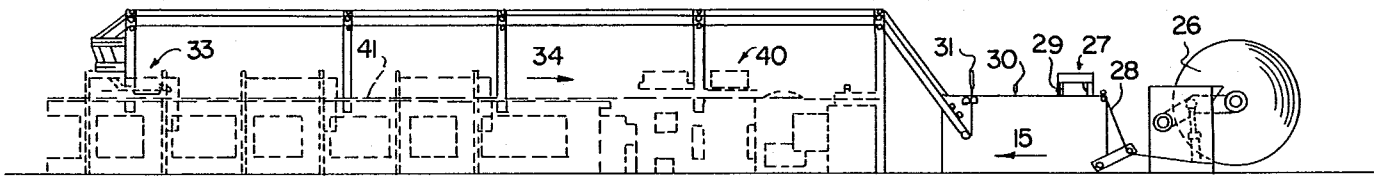

FIG. 7 A detail of an apparatus for producing blocks with pocket dividers according to FIG. 1 in side view.

Figure 8:
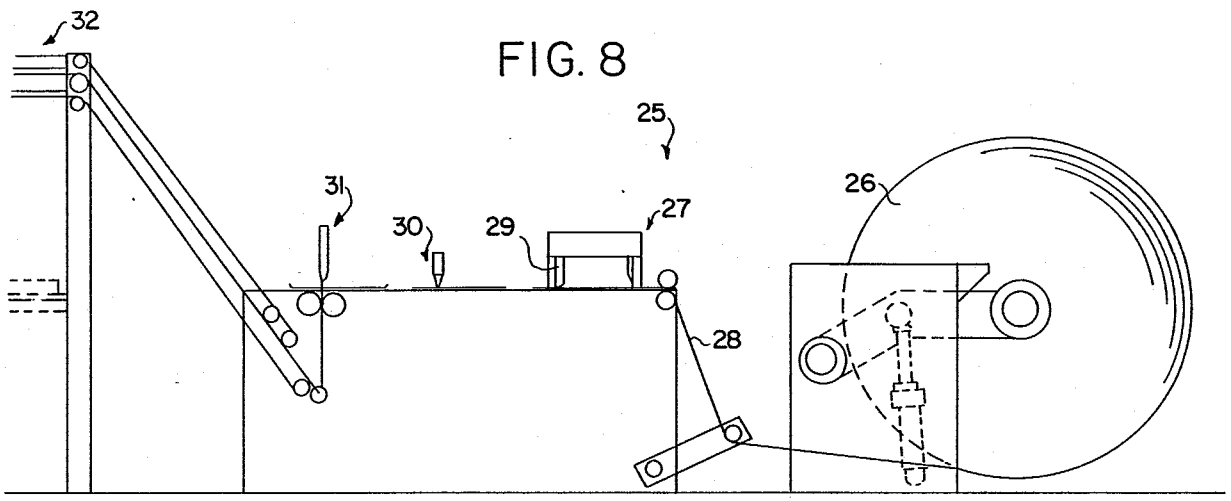

FIG. 8 The pocket divider manufacturing device provided on the apparatus according to FIG. 7 in a larger-scale representation.

Figure 9:
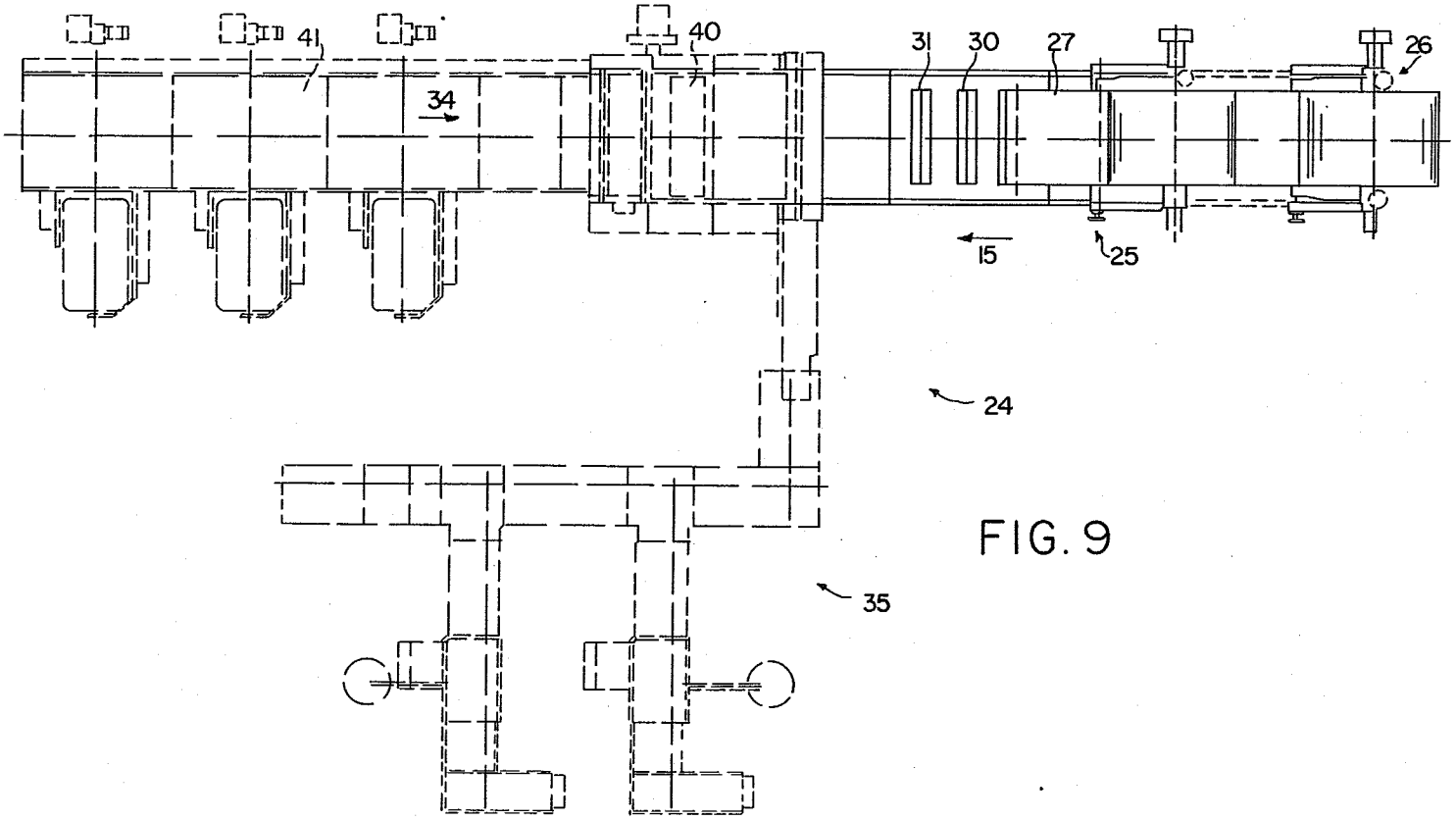

FIG. 9 Another embodiment of an apparatus in plan view.

Figure 10:
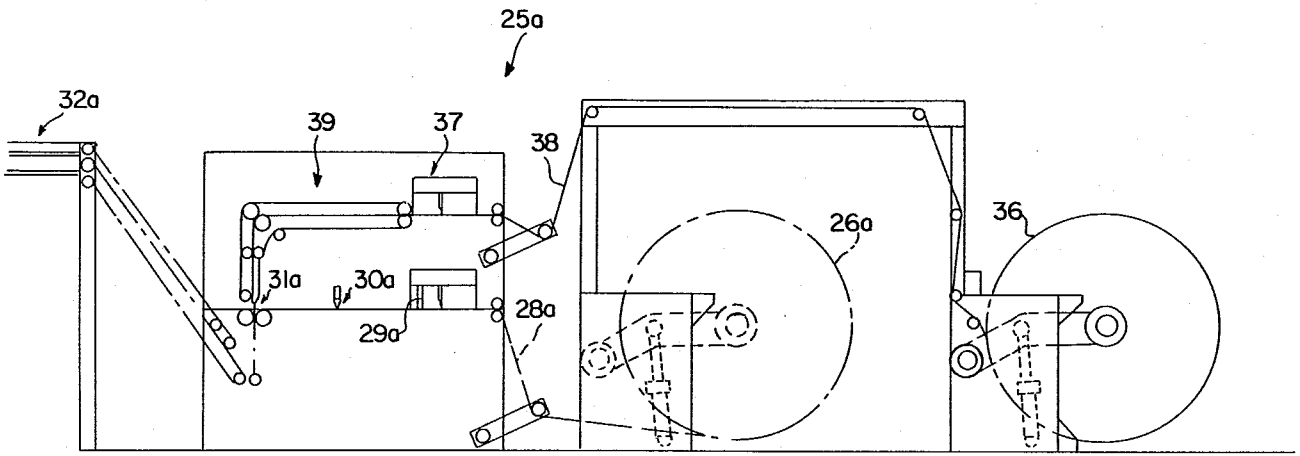

FIG. 10 The manufacturing means for the pocket dividers of the apparatus according to FIG. 9 in a representation corresponding to FIG. 8.

The pocket divider 1 shown in FIG. 1 has a back layer 2 formed by a sheet layer and whose size is generally the same as the sheet size of the associated block or is larger than the latter, in such a way that it is terminated flush on all sides with the sheets thereof. On one side of this back layer is provided a surface-smaller additional layer 3 facing the same, which from one of its outer edges can at least partly be raised from the back layer 2 in such a way that between the latter and additional layer 3 a pocket 4 in the form of a flat opening is formed, in which can be inserted articles parallel to the plane of pocket divider 1. Additional layer 3 is constructed in one piece with back layer 2 and is joined thereto by means of a single, linear fold 5 and an adhesive or glue seam 6 at right angles thereto. An outer edge of back layer 2 at right angles to fold 5 is provided as the back edge 7, in the vicinity of which the pocket divider 1, together with the remaining sheet layers is bound to form a block. The associated back edge 11 of additional layer 3 is formed by a cutting edge which, after folding additional layer 3 is cut congruently and jointly with back edge 7. Glue seam 6 is directly adjacent to the outer edges 8, 12 of back layer 2 and additional layer 3 remote from and parallel to back edges 7, 11 and which are also constructed as common-cut, congruent cutting edges, the glue seam 6 extending approximately over the entire length of outer edge 12 of additional layer 3. The edge of additional layer 3 associated with back edge 11 is secured with respect to the back layer 2 by binding the block, so that then a closed pocket is formed on three outer edges of additional layer 3. The outer edge 9 of back layer 2, which is generally at right angles at the top when using the block and which is at right angles to the back edges 7, 11 and outer edges 8, 12 or parallel to fold 5 and therefore to the lower outer edges 10, 14 of back layer 2 and additional layer 3 formed thereby, is spaced with respect to the upper outer edge 13 of additional layer 3 approximately parallel thereto, so that back layer 2 is free over part of its height.

Several juxtaposed, cohesive pocket dividers 1 are simultaneously produced from a material web strip blank 16 according to FIG. 2, which is conveyed during pocket production parallel to the glue seams 6 to be made in the direction of arrow 15 and from which after folding and glueing are cut the juxtaposed, multi-unit size pocket dividers at right angles to the direction of arrow 5. This blank is cut from a material web by cross cutting along its edges 17, 18 whlich are at right angles to the feed direction of arrow 15, said material web having at right angles to said arrow the same width as blank 16. During the cross cutting of the rear edge 18 in the direction of arrow 15, a fold groove is made on at least one side of blank 16, particularly on the inside along the zone to be folded or along fold line 19. Then, in the vicinity of the zones which are to be formed by glue seams 6, glue strips 20 or dotted glue lines are applied and namely only in those regions of blank 16, which form the back layers 2 after folding. The blank 16 is then folded along fold line 19 in such a way that blank 16 is in double layer form in the vicinity of the narrower strip forming additional layers 3 and said narrower strip is firmly joined by glue seam 6 to the strip projecting above it is in the direction of arrow 15. In the embodiment shown the blank 16 corresponds to five times unit size, i.e. five pocket dividers 1 can be produced from it by longitudinal cutting along the dot-dash cutting lines 21 parallel to arrow 15. This longitudinal cutting along the lines 21 immediately adjacent to glue strips 20 only takes place when at least part or all of the sheet layers of the block to be produced are brought together in superimposed form with the folded blank 16, said sheet layers having the same unit size width as the blank or blanks 16 at right angles to arrow 15, so that after bringing together all the sheet layers, including blanks 16, it is possible to cut/the individual block units and consequently they have flush terminating outer edges. The strip of blank 16 forming the back layers is designated 22, whilst the strip forming additional layers 3 is designated 23.

In FIGS. 3 to 6 corresponding parts are given the same reference numerals in FIGS. 1 and 2, but in FIGS. 3 and 4 are followed by the letter a and in FIGS. 5 and 6 by the letter b.

In the embodiment according to FIGS. 3 and 4 the back layer **2*a* is provided on both sides with identical or congruent pockets 4*a* or additional layers 3*a*, which are constructed in one piece with one another and are formed by a material blank separate from back layer 2*a*. This strip-like material blank 23*a* according to FIG. 4 is folded e.g. along its central fold line 19*a* after cross cutting and applying glue strips 20*a* and is simultaneously placed between the two fold members of material blank 22*a* until engaging on the fold inside, so that its associated outer edge 10*a* is only secured with respect to the additional layers 3*a* by engaging on the inside of the fold. The thus prefabricated, multi-unit size pocket divider layer is brought together with the remaining, corresponding multi-unit size sheet layers of the block and is jointly cut into the individual block unit along cutting lines 21*a***.

Whereas in the embodiments according to FIGS. 1 to 4, the feed direction of arrow 15 is parallel to the back edges, that of arrow **15*b* in the embodiment according to FIGS. 5 and 6 is at right angles to back edges 7*b*, 11*b*, i.e. the back layers 2*b* adhering in multi-unit size form in the material web blank 22*b* on longitudinal cutting are separated from one another along their outer edges at right angles to the rear edges. In this case the rear layer 2*b* and additional layers 3*b* are interconnected along their outer edges 10*b*, 14*b* by glue seams 6*b*, whilst the two additional layers 3*b* pass into one another in one-part form along a fold 5*b* forming the outer edge and the rear layer 2*b* engages with its associated outer edge 8*b* on the fold inside of fold 5*b*. Blanks 23*b* are not formed by a blank passing continuously in cohesive form in multi-unit size manner over the working width, but by in each case material strips passing over part of the associated unit width of the back layers, the number of material strips corresponding to the number of unit sizes. They are separated from corresponding narrow material webs by cross cuts, then provided with glue strips 20*b* passing over fold lines 19*b* and finally folded along fold lines 19*b* whilst applying blank 22*b* and consequently firmly connected to the latter, so that through blank 22*b* they are now cohesively juxtaposed in multi-unit size form. After bringing together with the other multi-unit size sheet layers of the block, all the layers are jointly cut along the cut lines 21*b*** into the individual block unit.

Particularly in the direction of the unit size cutting lines, the particular back layer can have a larger or smaller size than the remaining sheet layers of the block.

The apparatus 24 for producing the complete block, including the pocket dividers shown in FIGS. 7 to 9 is constructed in the manner of a production line with successive stations, which are successively passed by the blanks and sheet layers. At one end apparatus 24 has a production or manufacturing means 25 for producing the pocket dividers, which are produced from a single material web kept ready in a supply means 26. The latter is in the form of a paper reel rotatably mounted in a bracket about a horizontal axis at right angles to the feed direction. Material web 28 is supplied from supply means 26 after multiple deflections to a cutting device 27, which is integrated with a grooving device, which simultaneously with the cross cut performed by the cutting device 27 makes the folding groove in the vicinity of the fold line. From cutting device 27 the material web portion is fed in the feed direction to an immediately following joining station 30, which has at right angles to the feed direction the same number of glue application devices as there are glue strips to be applied and in each case they apply one glue or hot glue strip to the web blank. Following the joining station 30 the web portions pass in the feed direction into the vicinity of an immediately following folding station 31, in which they are folded along the groove folding line accompanied by right-angled, downwardly directed deflection of their horizontal feed direction in the vicinity of stations 27, 30 and are then supplied to the inlet end of the conveyor 32. Conveyor 32 initially rises from its inlet end located below folding station 31 and then travels horizontally above the remaining apparatus 24 to a supply station 33, which is provided in the vicinity of the remaining apparatus, in which the individual multi-unit size sheet layers and pocket dividers are brought together to the predetermined block thickness, so that multi-unit size, prefabricated pocket dividers can at this point be supplied to the sheet layers, optionally cover sheets, bottom sheets, supplementary sheets, etc. These pocket dividers are deflected at the outlet end of conveyor 32 downwards in the feed direction thereof by approximately 180° back into the opposite direction, namely that of arrow 34, in which the remaining apparatus procedes and which is directed counter to the feed direction of arrow 15 or that of conveyor 32 back in the direction of means 25. In the vicinity of the end of the remaining apparatus facing means 25 the punched sheet layers cut into unit sizes and collected into partial layers are fed at right angles to the conveying direction of arrow 34 to the side in stations 35, in which the remaining processing, e.g. the binding of the sheet layers to blocks is carried out. The remaining apparatus also functions from not shown supply means formed by material web reels, said webs are cut through cross cuts into portions and then said multi-unit size portions are processed in the described manner.

In FIG. 10 the corresponding parts are given the same reference numerals as in FIG. 8, but followed by the letter a.

Means 25*a* according to FIG. 10 is used for producing pockets dividers 1*a* according to FIGS. 3 and 4. Production means 25*a* has two directly succeeding material web reels in each case forming a supply means 26*a* and 36, from which two material webs 28*a*, 38 are drawn and processed in superimposed manner. The lower material web 28*a* is used for producing the folded additional layers 3*a* and is cut into multi-unit size web portions in the vicinity of cutting device 27*a* and during cutting each of said portions is simultaneously grooved along the predetermined fold line by grooving devices 29*a* located upstream of the cutting point in the feed direction. The juxtaposed glue strips 20*a* are then applied in joining station 30*a* and immediately thereafter additional layers 3*a* are folded along fold line 19*a* in folding station 31*a*. Material web 38 running above it is cut to web portions corresponding to material blanks 22*a* in a cutting device 37 positioned above cutting device 27*a*, said portions being successively transferred to a feed means 39, which deflects them vertically downward above folding station 31*a* and at the start of or during the folding of blanks 23*a* is so placed on their fold inside with the associated outer edge 10*a*, that back layer 2*a* during the folding of additional layers 3*a* is located in the predetermined position between them and is fixed along the glue strips 20*a*. After leaving folding station 31*a*, the thus produced multi-unit size pocket dividers are transferred below the folding station 31*a* to conveyor 31*a* and supplied to the remaining apparatus.

The inventive construction completely avoids faults in the production sequence, which can easily occur as a result of multiply folded pocket dividers, which is particularly important if the sheet layers of the block are to be bound by spiral bindings engaging in punched rows of holes. The binding holes are preferably made in the individual units prior to longitudinal cutting. The individual layers of the pocket dividers can be made from different materials, e.g. with a different colour. As only a single back layer is required for each pocket divider, a material saving of approximately 30% is obtained as compared with a double back layer.

Known machines can be used as the apparatus for actually producing the block. These machines may be provided along a conveyor path 11 and following supply means 33 with respect to the feed direction with at least one application station for cover sheets, bottom sheets, supplementary sheets and/or the like, optionally a punching station for producing the binding holes and then a cutting device 40 for cutting the units, after which there is a collecting station for collecting the partial layer compounds.

What is claimed is:

1. An apparatus for producing multilayer blocks from multilayer cross layer units, each of said blocks being formed by a combination of separate material layers and at least one pocket layer (1) providing at least one pocket (4) on at least one side of a back layer (2) by bearing at least one additional layer (3), each of said blocks determining an individual block unit width extending in a cross direction of the cross layer unit, said apparatus comprising:

a conveyor path (41) for the cross layer units, each of said cross layer units extending over several individual block unit widths juxtaposed in the cross direction determined by the conveyor path (41), said cross layer units determining an extension of an operating width of the apparatus, said extension, corresponding to a number of individual block unit widths, thereby providing an extension of a multi-unit width;

a block cutting device (40) for separating said cross layer units into individual block units, said block cutting device (40) providing a block cutting station in the vicinity of the conveyor path (41), wherein a supply station (33) for supplying cross pocket units (FIG. 2) of juxtaposed pocket layers (1) for separate individual block units is issuing into the conveyor path (41) upstream of the block cutting device (40).

2. An apparatus according to claim 1, wherein means are provided for producing said cross layer units (FIG. 2) from at least one material web delivered by a material store, a cross cutting unit being provided for cross cutting said at least one material web to form the cross layer units, the supply station (33) for the cross pocket units and the block cutting device (40) being arranged behind one another along said conveyor path (41), said at least one material web defining said multi-unit width, said supply station (33) issuing into the conveyor path (41) at least over an extension of the multi-unit width.

3. An apparatus according to claim 1, wherein a pocket manufacturing means (25) of manufacturing the cross pocket units is provided, said pocket manufacturing means (25) being connected to the supply station (33) by a conveyor line (32) defining a conveying direction (15).

4. An apparatus according to claim 3, wherein along the conveyor line (32) of the pocket manufacturing means (25) is provided at least one storing means (26) for at least one material web (28), a cross cutting device (27) for cutting said at least one material web (28) into strips extending over a number of individual block unit widths juxtaposed across to the conveying direction (15) and a joining station (30) with a number of joining means, said number of joining means corresponding to the number of individual block unit widths determined by the multi-unit width, in each of said pocket layers (1) the additional layer (3) being fixed to the back layer (2) along an outer edge of the pocket layer, said joining means being constructed for successively fixing the additional layers (3) to the back layers (2) along said outer edges orientated parallel to the conveying direction (15).

5. An apparatus according to claim 4, wherein the joining station (30) of said pocket manufacturing means (25) has an adhesive application station for applying an adhesive to at least one of said layer units.

6. An apparatus according to claim 5, wherein the adhesive application station is provided upstream of the folding station (31) with respect to the conveying direction (15).

7. An apparatus according to claim 3, wherein the pocket manufacturing means (25) is provided with a folding station (31) for folding the additional layers (3)

from a part of the back layers, said folding station (31) being provided for folding over the extension of said operating width, said folding station (31) with respect to the conveying direction (15) being provided downstream of the cross cutting device (27).

8. An apparatus according to claim 3, wherein the pocket manufacturing means (25*a*) has a material web storing means (36) for a back layer-material web (38), a material web storing means (26*a*) for an additional layer-material web (28*a*) and separate cross cutting devices (37, 27*a*) for separating back layer units (22*a*) and additional layer units (23*a*) by cross cutting said material webs (38, 28*a*), said back layer and additional layer units extending over said multi-unit width.

9. An apparatus according to claim 8, wherein the pocket manufacturing means (25*a*) is provided with an assembling station (31*a*) for successively bring together one additional layer unit (23*a*) and one back layer unit (22*a*), said assembling station (31*a*)with respect to the conveying direction (15) being located downstream of at least one cross cutting device (37, 27*a*), said assembling station being formed by a folding station (31*a*) for folding the additional layer units (23*a*).

10. An apparatus according to claim 3, wherein the conveying direction (15) of the pocket manufacturing means (25) is substantially opposite to the feed direction (34) of the conveyor path (41) of the apparatus (24), said pocket manufacturing means (25) having a delivery end for delivering said cross pocket units, a conveyor means (32) being provided for connecting said delivery end to the supply station (33).

11. An apparatus according to claim 10, wherein the conveyor means (32) is located above the conveyor path (41) of the apparatus (24).

12. An apparatus according to claim 1, wherein at least one of the material layers is a layer of paper material.

13. An apparatus according to claim 1, wherein means are provided for combining said material layers and at least one pocket layer (1) by a back binder.

14. An apparatus according to claim 1, wherein said block cutting device (40) is provided for separating said cross layer units together with at least one cross pocket unit into individual block units by longitudinally cutting said cross layer units along said cutting lines (21) parallel to the feed direction (34) of the conveyor path (41).

15. A pocket layer for a block of material layers having back edges associated to a back of the block, said pocket layer (1) having at least two layers (2, 3), one of said at least two layers (2, 3) being a back layer (2) and at least one of said at least two layers (2, 3) being an additional layer (3) connected to the back layer (2) to form at least one pocket (4), said back layer (2) having outer edges (7, 8, 9, 10) providing a back edge (7) and remote edges (8, 9, 10) said back edge (7) of the back layer (2) being associated to the back of the block, said additional layer (3) having outer edges (11, 12, 13, 14) providing a back edge (11) associated to the back of the block, said additional layer (3) joining on substantially to at least one remote edge (10, 8) of the back layer (2), said additional layer (3) being fixed with respect to the back layer (2) in the vicinity of at least one of said remote edges (10, 8), thereby providing at least one pair of a secured edge of the additional layer (3) and of an associated securing edge of the back layer (2), said secured and securing edges of said pair being provided in a position, wherein at least one secured edge (12) of the additional layer (3) and at least one associated securing edge (8) of the back layer (2) are bounded by congruent cutting edges commonly cut in the position, said at least one secured edge (12) and said at least one securing edge (8) being fixed with respect to one another by direct fixing of facing inner surfaces of said layers (2, 3).

16. A pocket layer according to claim 15, wherein said remote edge (10) of the back layer (2) is provided at an angle to the back edge (7) of said back layer (2).

17. A pocket layer according to claim 15, wherein said remote edge (8) of the back layer is provided opposite to the back edge (7) of said back layer (2).

18. A pocket layer according to claim 15, wherein a remote edge of the additional layer (3) facing away from the back edge (7) of the back layer (2) and an associated outer edge of the back layer (2) are bounded by congruent cutting edges (21).

19. A pocket layer according to claim 18, wherein said remote edge of the additional layer (3) and the associated outer edge of the back layer (2) are fixed with respect to one another by direct fixing of facing inner surfaces of said layers (2, 3).

20. A pocket layer according to claim 15, wherein an outer edge of the additional layer (3*b*) provided at angles to the back edge (7*b*) of the back layer (2*b*) and an associated outer edge of the back layer (2*b*) are bounded by congruent cutting edges.

21. A pocket layer according to claim 20, wherein said outer edges of the additional layer (3*b*) and of the back layer (2*b*) are fixed with respect to one another by direct fixing of facinga inner surfaces of said layers (2*b*, 3*b*).

22. A pocket layer according to claim 15, wherein a single one of said outer edges of the additional layer (3, 3*a*, 3*b*) emanates from a fold (5, 5*a*, 5*b*) of said additional layer (3, 3*a*, 3*b*).

23. A pocket layer according to claim 22, wherein said single one of the outer edges of the additional layer joins on at angles to a cutting edge.

24. A pocket layer according to claim 15, wherein the additional layer (3) is connected to the back layer (2) in one piece of means of a fold (5).

25. A pocket layer according to claim 15, wherein only one single additional layer (3) is provided on the back layer (2).

26. A pocket layer according to claim 15, wherein the additional layer (3*a*) is formed by a separate material blank (22*a*).

27. A pocket layer according to claim 26, wherein the separate material blank (22*a*) receives one of said at least one remote edges of the back layer in the manner of a sheathe connection in a fold (5*a*).

28. A pocket layer according to claim 26, wherein said separate material blank has two fold legs, said two fold legs forming a pocket (4*a*) on each side of the back layer (2*a*).

29. A pocket layer according to claim 15, wherein the back layer (2) is constructed in a single layer form.

30. A pocket layer according to claim 15, wherein at least one of the layers is made of paper material.

* * * * *

UNITED STATES PATENT AND TRADEMARK OFFICE

CERTIFICATE OF CORRECTION

PATENT NO. : 4,779,897

DATED : October 25, 1988

INVENTOR(S) : Walter Schall and Gerhard Schnell

It is certified that error appears in the above-identified patent and that said Letters Patent is hereby corrected as shown below:

Column 5, line 5 delete "whilch" and insert --which--.

Column 5, line 20 delete "is"

Column 8, line 36 delete "of" and insert --for--.

Column 10, line 34 delete "facinga" and insert --facing--.

Signed and Sealed this

Ninth Day of July, 1991

*Attest:*

HARRY F. MANBECK, JR.

*Attesting Officer*

*Commissioner of Patents and Trademarks*